US007083251B2

(12) United States Patent
Kang et al.

(10) Patent No.: US 7,083,251 B2
(45) Date of Patent: Aug. 1, 2006

(54) METHOD OF COMPENSATING SHEET FEEDING ERRORS IN INK-JET PRINTER

(75) Inventors: Kyung-pyo Kang, Gyeonggi-do (KR); Hyoung-il Kim, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 179 days.

(21) Appl. No.: 10/753,333

(22) Filed: Jan. 9, 2004

(65) Prior Publication Data

US 2004/0165023 A1 Aug. 26, 2004

(30) Foreign Application Priority Data

Feb. 15, 2003 (KR) ..... 10-2003-0009606

(51) Int. Cl.
*B41J 29/393* (2006.01)

(52) U.S. Cl. ..... 347/19; 347/16

(58) Field of Classification Search ..... None
See application file for complete search history.

(56) References Cited

U.S. PATENT DOCUMENTS

| | | | |
|---|---|---|---|
| 6,478,401 B1 | 11/2002 | King et al. | |
| 6,755,499 B1 * | 6/2004 | Castano et al. | 347/19 |
| 2003/0025922 A1 | 2/2003 | Otsuki | |

FOREIGN PATENT DOCUMENTS

| | | |
|---|---|---|
| EP | 1 211 084 A1 | 11/2000 |
| EP | 1 245 399 A2 | 9/2001 |
| JP | H5-096796 | 4/1993 |
| JP | 2000-153660 | 6/2000 |
| JP | 2000-238339 | 9/2000 |

OTHER PUBLICATIONS

European Search Report; Dated: Jun. 23, 2004.

* cited by examiner

*Primary Examiner*—David M. Gray
*Assistant Examiner*—Jannelle M. Lebron
(74) *Attorney, Agent, or Firm*—Staas & Halsey LLP

(57) ABSTRACT

A method of compensating a sheet feeding error in an ink-jet printer includes printing a test pattern on the sheet; scanning the printed test pattern using the image sensor and measuring a distance $W_1$ between a starting point $X_{1s}$ and an ending point $X_{1e}$ of the test pattern; driving the feeding roller and moving the sheet to a set distance $H_m$ so that the set distance $H_m$ is shorter than a length of the test pattern in a sheet feeding direction; scanning the test pattern using the image sensor and measuring a distance $W_2$ between a starting point $X_{2s}$ and an ending point $X_{2e}$ of the test pattern; calculating a distance H, along which the sheet is actually fed, from a difference between the distances $W_2$ and $W_1$; calculating a feeding error E of the sheet from a difference between the feeding distance H and the set distance $H_m$; and compensating for the sheet feeding error E at the set distance $H_m$.

10 Claims, 5 Drawing Sheets

METHOD OF COMPENSATING SHEET FEEDING ERRORS IN INK-JET PRINTER

CROSS-REFERENCE TO RELATED APPLICATIONS

This application claims the priority of Korean Patent Application No. 2003-9606, filed on Feb. 15, 2003, in the Korean Intellectual Property Office, the disclosure of which is incorporated herein in its entirety by reference.

BACKGROUND OF THE INVENTION

1. Field of the Invention

The present invention relates to a method of compensating sheet feeding errors in an ink-jet printer, and more particularly, to a method of compensating a feeding error of a sheet fed in an X direction, using an optical sensor that travels in a Y direction in an ink-jet printer. The present invention also relates to a method of compensating a feeding error in every section of a circumference of a feeding roller by equally dividing the circumference of the feeding roller by n sections.

2. Description of the Related Art

In general, an ink-jet printer includes a carriage on which an ink cartridge is mounted to print an image on a sheet of material and which makes a printhead that ejects ink move back and forth in a primary scanning direction (a Y direction), and a feeding roller, which moves the sheet in a secondary scanning direction (an X direction). A printer using the feeding roller requires precise control of the feeding roller. If control of the feeding roller is unstable during a printing operation, a black line may occur due to printing superimposition, or a white space may occur due to a widened space between lines.

FIG. 1 schematically illustrates the structure of an apparatus in which a conventional method of compensating sheet feeding errors in an ink-jet printer is used. Referring to FIG. 1, a carriage 10 in an ink-jet printer (not shown) travels in a Y direction perpendicular to a sheet feeding direction (an X direction) above a platen (not shown) on which a sheet P of material is placed. At least one ink-jet cartridge 20 is mounted on the cartridge 10, and a printhead (not shown) in which a plurality of nozzles (not shown) are formed is placed at a bottom of the ink cartridge 20. One side of the cartridge 10 is fixedly mounted on a traveling belt 30, and the other side thereof is mounted to slide on a guide rail 31. Thus, the cartridge 10 is driven by an electromotor 33 via a traveling belt 30, in a back and forth motion in the Y direction. A control unit 40 precisely controls the Y reciprocating movement of the cartridge 10 by counting the number of pulse signals generated in a linear encoder 12 attached to the carriage 10, when the linear encoder 12 passes over a plurality of marks 14 of an encoder strip 16 formed at regular intervals.

Meanwhile, the sheet P is transferred by a feeding roller 50 in a secondary scanning direction (the X direction). The feeding roller 50 is moved via a feeding roller driving motor 51, moving a predetermined angle each time it moves. An encoder disc wheel 52 is mounted on a circumference of one end of the feeding roller 50. A rotary encoder sensor 53 to measure a rotation angle of the encoder disc wheel 52 generates pulse signals corresponding to equally spaced slits (52*a*) formed on a circumference of the encoder disc wheel 52, and the control unit 40 controls a rotation angle of the feeding roller 50, i.e., a transfer distance in the X direction of the sheet P, by counting the number of the pulse signals.

Meanwhile, to verify the precision of the rotary encoder sensor 53, a linear encoder sensor 60 is fixedly placed in a moving direction of the sheet P, and the length of the sheet P, which is actually fed, is measured. That is, the moving distance of the sheet P read by the linear encoder sensor 60 is measured using a linear scale encoder strip 61 that moves together with the sheet P. By comparing the actual moving distance of the sheet P with a moving distance on the circumference of the feeding roller 50 read by the rotary encoder sensor 53, an error of the rotary encoder sensor 53, i.e., a feeding error caused by the curvature and abrasion of the surface of the feeding roller 50, is measured, and the feeding roller driving motor 51 is controlled to compensate for the measured error.

However, the conventional method of compensating sheet feeding errors in an ink-jet printer is performed to compensate an error of the rotary encoder sensor 53 caused by the feeding roller 50. To perform the method in an ink-jet printer, a linear encoder sensor to detect an error should be attached to the printer in an X direction, the output of the linear encoder sensor should be connected to an additional measuring system, and a linear scale encoder strip should be attached onto a sheet of material. Thus, a user cannot perform the method easily.

In addition, to calibrate a printer having a high resolution, the method requires a linear encoder sensor having a high resolution to detect a linear strip.

SUMMARY OF THE INVENTION

The present invention provides a method of compensating a sheet feeding error in an ink-jet printer, by which a feeding error of sheet fed in a secondary scanning direction is measured and compensated using an optical sensor to sense a test pattern in two parallel lines.

According to an aspect of the present invention, a method compensates for a sheet feeding error in an ink-jet printer, the printer comprising a rotation measuring unit of a sheet feeding roller, a unit to measure a reciprocating movement of an ink cartridge mounted on a carriage, and a sensor to measure an image printed on the sheet. The method comprises printing a test pattern on the sheet, scanning the printed test pattern using the image sensor and measuring a distance $W_1$ between a starting point $X_{1s}$ and an ending point $X_{1e}$ of the test pattern, driving the feeding roller and moving the sheet to a set distance $H_m$ so that the set distance $H_m$ is shorter than a length of the test pattern in a sheet feeding direction, scanning the test pattern using the image sensor and measuring a distance $W_2$ between a starting point $X_{2s}$ and an ending point $X_{2e}$ of the test pattern, calculating a distance H, along which the sheet is actually fed, from a difference between the distances $W_2$ and $W_1$, calculating a feeding error E of the sheet from a difference between the feeding distance H and the set distance $H_m$, and compensating the sheet feeding error E at the set distance $H_m$.

Generally in the operation of printing the test pattern, the test pattern is printed within one swath.

Also, the image sensor is typically an optical sensor attached to the carriage.

Generally, in the operation of scanning the printed test pattern, locations of a starting point and an end point where a line scanned by the optical sensor intersects the test pattern are detected by counting marks of an encoder strip using a linear encoder sensor mounted on the carriage.

Typically, the rotation measuring unit is a rotary encoder sensor to sense slits of an encoder disc wheel installed on a circumference of the feeding roller, and in the operation of driving the feeding roller and moving the sheet to a set distance, the feeding roller is controlled by the rotary encoder sensor to be rotated by a predetermined angle.

Also, generally, the test pattern is a right triangle, the right angle of which is formed on an end of a side parallel to the sheet feeding direction, and in the operation of calculating a distance H along which the sheet is actually fed, the feeding distance H is calculated from an angle θ to face a side of the right triangle perpendicular to the sheet feeding direction, by Equation 1:

$$H=(W_2-W_1)/\tan\theta \quad (1).$$

Typically, in the operation of driving the feeding roller and moving the sheet to a set distance, the feeding roller is driven by a set distance $H_m$ which corresponds to a first section where the circumference of the feeding roller is equally divided by n sections so that the set distance $H_m$ is shorter than the length of the test pattern in the sheet feeding direction, and the method further comprises repeatedly performing the operations recited above for each other section of the circumference of the feeding roller.

Generally, the operation of compensating the sheet feeding error comprises storing the sheet feeding error E in a look-up table, and setting a distance obtained by compensating the sheet feeding error E at the set distance $H_m$ as a compensated set distance of a corresponding section Typically, in the operation of driving the feeding roller and moving the sheet to a set distance in the operation of scanning the test pattern, a second test pattern used to detect a sheet feeding error in a next section is printed, and in the operation of scanning the test pattern, a distance $W_1$ between a starting point $X_{1s}$ and an end point $X_{1e}$ of the second test pattern is calculated.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
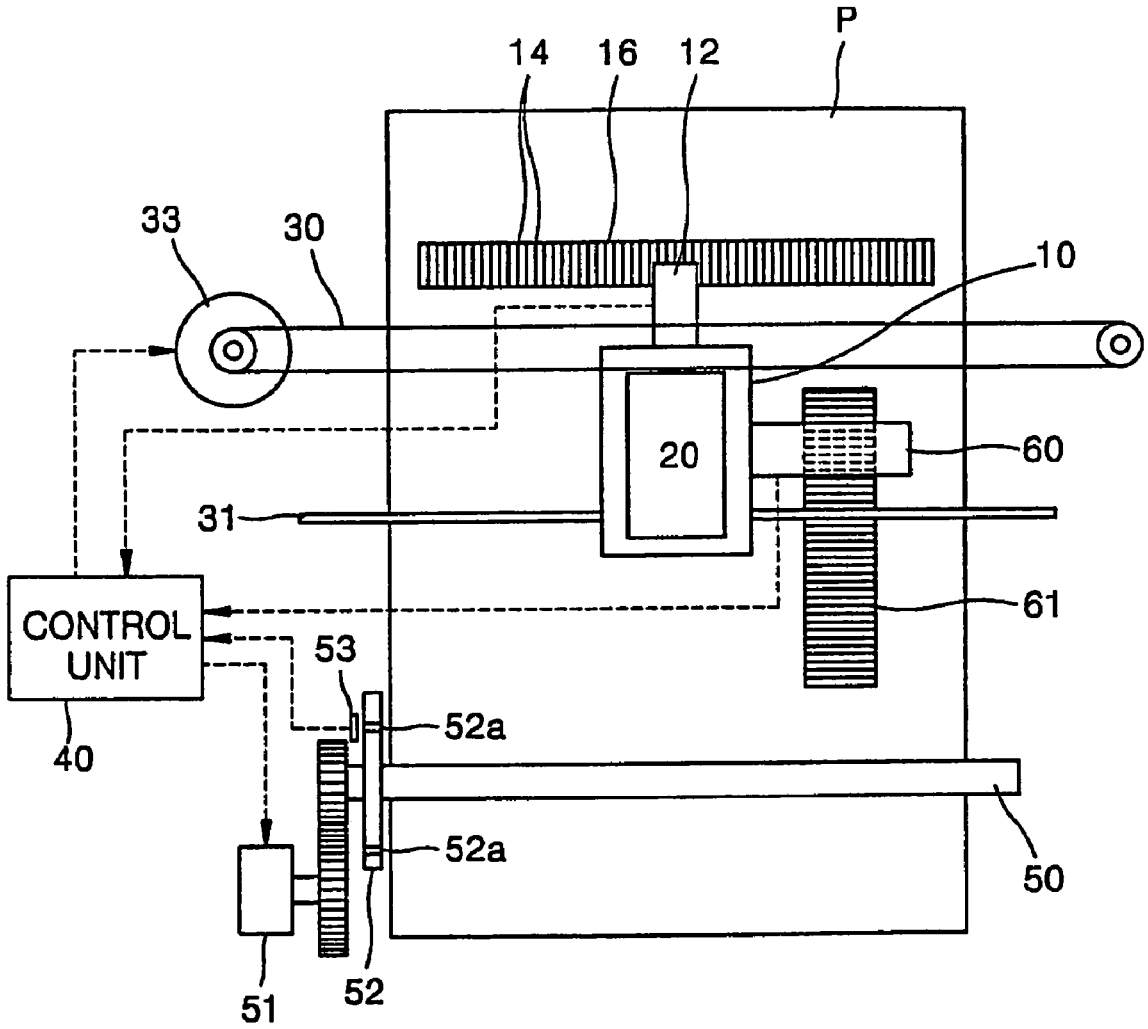
FIG. 1 (PRIOR ART)
FIG. 1 schematically illustrates the structure of an apparatus in which a conventional method of compensating sheet feeding errors in an ink-jet printer is used.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, embodiments of the present invention will be described in detail with reference to the accompanying drawings. The thicknesses of layers or regions shown in the drawings are exaggerated for clarity.

Figure 2:
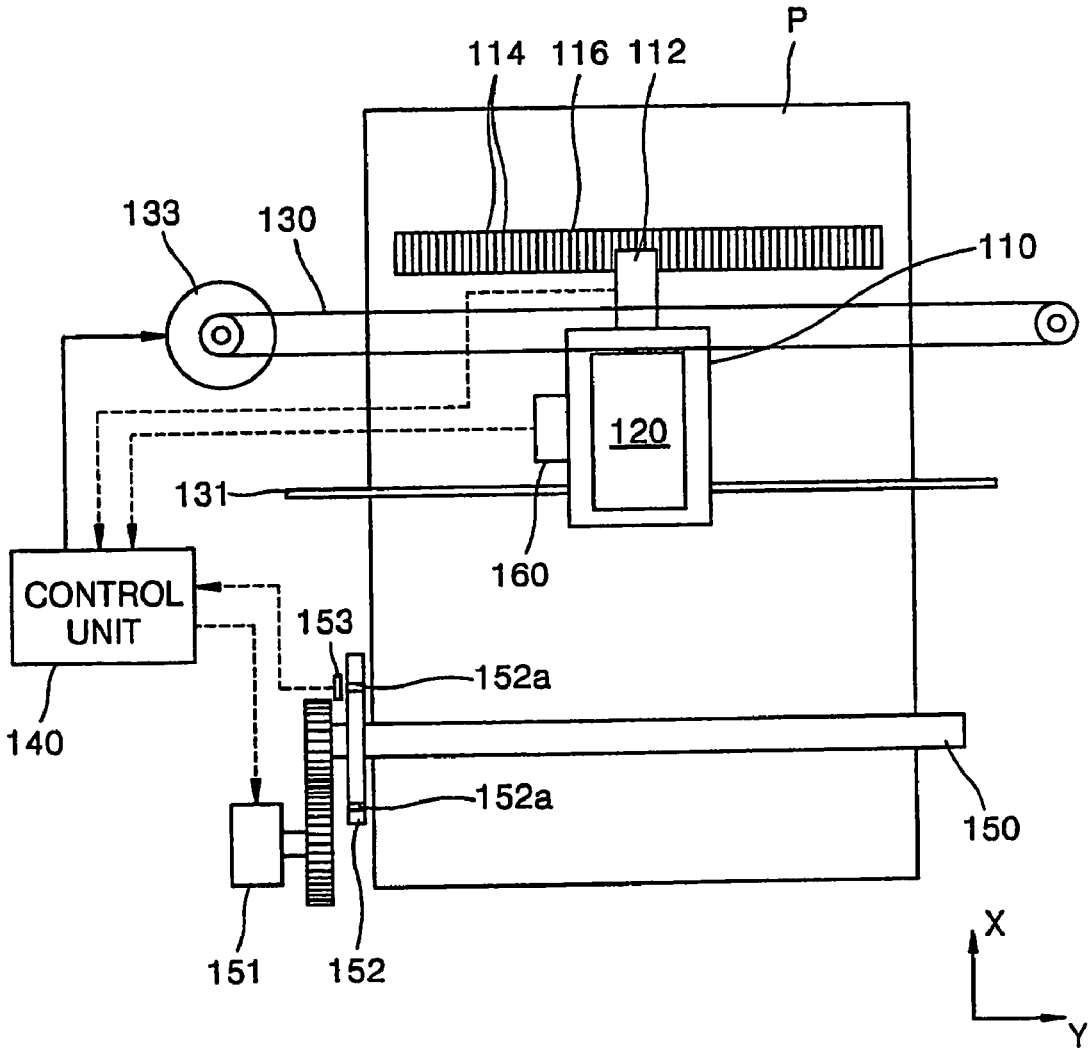
FIG. 2 schematically illustrates the structure of an ink-jet printer in which a method of compensating a sheet feeding error in an ink-jet printer is used, according to an embodiment of the present invention.

FIG. 2 schematically illustrates the structure of an ink-jet printer in which a method of compensating a sheet feeding error in an ink-jet printer is used, according to an embodiment of the present invention. Referring to FIG. 2, a carriage 110 in an ink-jet printer (not shown), travels in a Y direction perpendicular to a sheet feeding direction (an X direction) above a platen (not shown) on which sheet P is placed. At least one ink-jet cartridge 120 is mounted on the carriage 110, and a printhead (not shown) in which a plurality of nozzles (not shown) are formed is placed at a bottom of the ink cartridge 120. One side of the carriage 110 is fixedly mounted on a traveling belt 130, and the other side thereof is mounted to slide on a guide rail 131. Thus, the cartridge 110 is driven by an electromotor 133 via a traveling belt 130, in a back and forth motion in the Y direction. A control unit 140 precisely controls the Y reciprocating movement of the cartridge 110 by counting the number of pulse signals generated in a linear encoder sensor 112 attached to the carriage 110, when the linear encoder sensor 112 passes over a plurality of marks 114 of an encoder strip 116 formed at regular intervals.

The sheets that are input to the ink-jet printer may comprise paper, transparencies, various plastic materials, and any other suitable material to receive printing. Due to different thicknesses and consistencies of input sheets, the present invention may further include an adjustment to optimize feeding of the material and/or thickness of the input sheets.

An optical sensor 160 that detects an image on the sheet P placed on the platen is arranged at the carriage 110. The optical sensor 160 detects the location of the image in the Y direction using the linear encoder sensor 112.

Meanwhile, the sheet P is transferred by a feeding roller 150 in a secondary scanning direction (the X direction). The feeding roller 150 is moved by a feeding roller driving motor 151, moving a predetermined angle each time it moves. An encoder disc wheel 152 is mounted on a circumference of one end of the feeding roller 150. A rotary encoder sensor 153 to measure a rotation angle of the encoder disc wheel 152 generates pulse signals corresponding to equally spaced slits (152*a*) formed on a circumference of the encoder disc wheel 152, and the control unit 140 controls a rotation angle of the feeding roller 150, i.e., a transfer distance in the X direction of the sheet P, by counting the number of the pulse signals.

Figure 3:
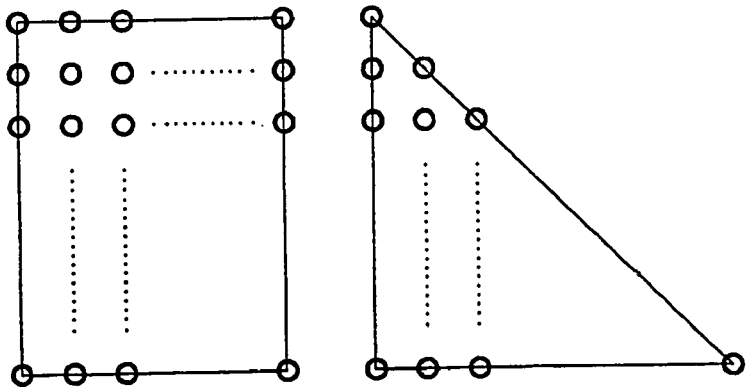
FIG. 3 illustrates an example of a test pattern used in the method of compensating a sheet feeding error in an ink-jet printer, according to an embodiment of the present invention.

FIG. 3 illustrates an example of a test pattern used in the method of compensating of a sheet feeding error in an ink-jet printer, according to an embodiment of the present invention. Referring to FIG. 3, ink ejected from a plurality of nozzles is sprayed onto the sheet to form a predetermined rectangle and a right triangle. The test pattern is formed by a combination of the rectangle and right triangle. The present invention discloses a method of measuring a feeding error of a sheet of material using the test pattern having the triangle. The test pattern having the rectangle is used to facilitate the measurement performed by the optical sensor 160. In the related art, to detect lines on a linear scale encoder strip attached onto paper, a sensor of high sensitivity is required, and thus, a printer cost increases. However, according to the present invention, a measurement of at least the width of the test pattern having the rectangle is used. Thus, the sensor of high sensitivity is not needed.

Generally, the test pattern is formed by one swath, and thus is formed by one traveling of an ink cartridge.

Figure 4:
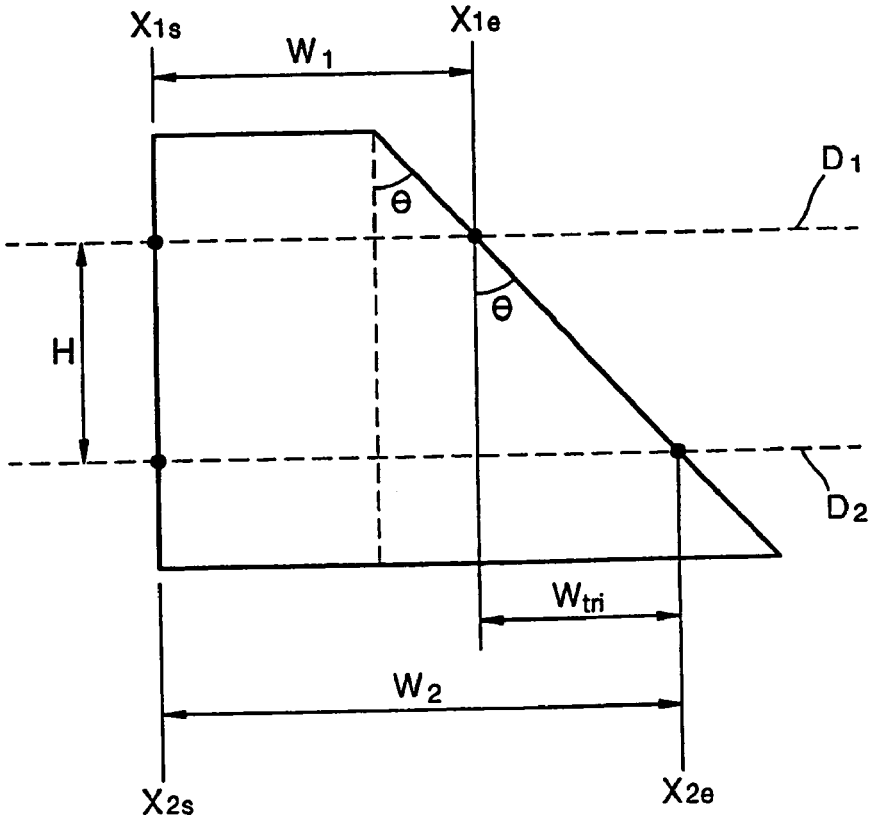
FIG. 4 illustrates a method of measuring a sheet feeding error using the test pattern of FIG. 3.

FIG. 4 illustrates a method of measuring a sheet feeding error using the test pattern of FIG. 3. Referring to FIG. 4, the test pattern is printed on a sheet of material by one swath. Subsequently, while the carriage 110 travels above the printed test pattern, a starting point $X_{1s}$ and an end point $X_{1e}$, where a line $D_1$ detected by the optical sensor 160 intersects the test pattern, are measured using the linear encoder sensor 112 and the optical sensor 160 attached to the carriage 110. A first width $W_1$ of the test pattern is obtained by subtracting the starting point $X_{1s}$ from the end point $X_{1e}$, as shown in Equation 1.

$$W_1=X_{1\,\theta}-X_{1s} \tag{1}$$

Subsequently, the feeding roller motor 151 is driven so that the sheet P is moved by a predetermined distance in a secondary scanning direction within the test pattern. In this case, slits of the encoder disc wheel 152 are sensed by the rotary encoder sensor 153, and simultaneously, a moving distance $H_m$ by the feeding roller 150 is controlled.

Subsequently, while the carriage 110 travels above the printed test pattern, a starting point $X_{2s}$ and an end point $X_{2e}$, where a line $D_2$ detected by the optical sensor 160 intersects the test pattern, are measured using the linear encoder sensor 112 and the optical sensor 160 attached to the carriage 110. A second width $W_2$ of the test pattern is obtained by subtracting the starting point $X_{2s}$, from the end point $X_{2e}$, as shown in Equation 2.

$$W_2=X_{2e}-X_{2s} \tag{2}$$

A width $W_{tri}$ of a small triangle (indicated by slanting lines) is obtained by subtracting the first width $W_1$ from the second width $W_2$.

$$W_{tri}=W_2-W_1 \tag{3}$$

Meanwhile, an angle θ of a triangle of the test pattern is preset. Since this angle is the same as an angle of the small triangle, a moving distance of the sheet, i.e., the height of the small triangle, is obtained by Equation 4.

$$H=W_{tri}/\tan\theta \tag{4}$$

Here, a feeding error of the sheet is obtained by subtracting the moving distance $H_m$ of the feeding roller 150 from the feeding distance H of the sheet, as shown in Equation 5.

$$E=H-H_m \tag{5}$$

Accordingly, the feeding distance H of the sheet is measured by the optical sensor 160 that travels in the Y direction, using the test pattern having the triangle.

Hereinafter, a method of compensating a sheet feeding error in an ink-jet printer, according to an embodiment of the present invention will be described in detail with reference to the accompanying drawings.

Figure 5:
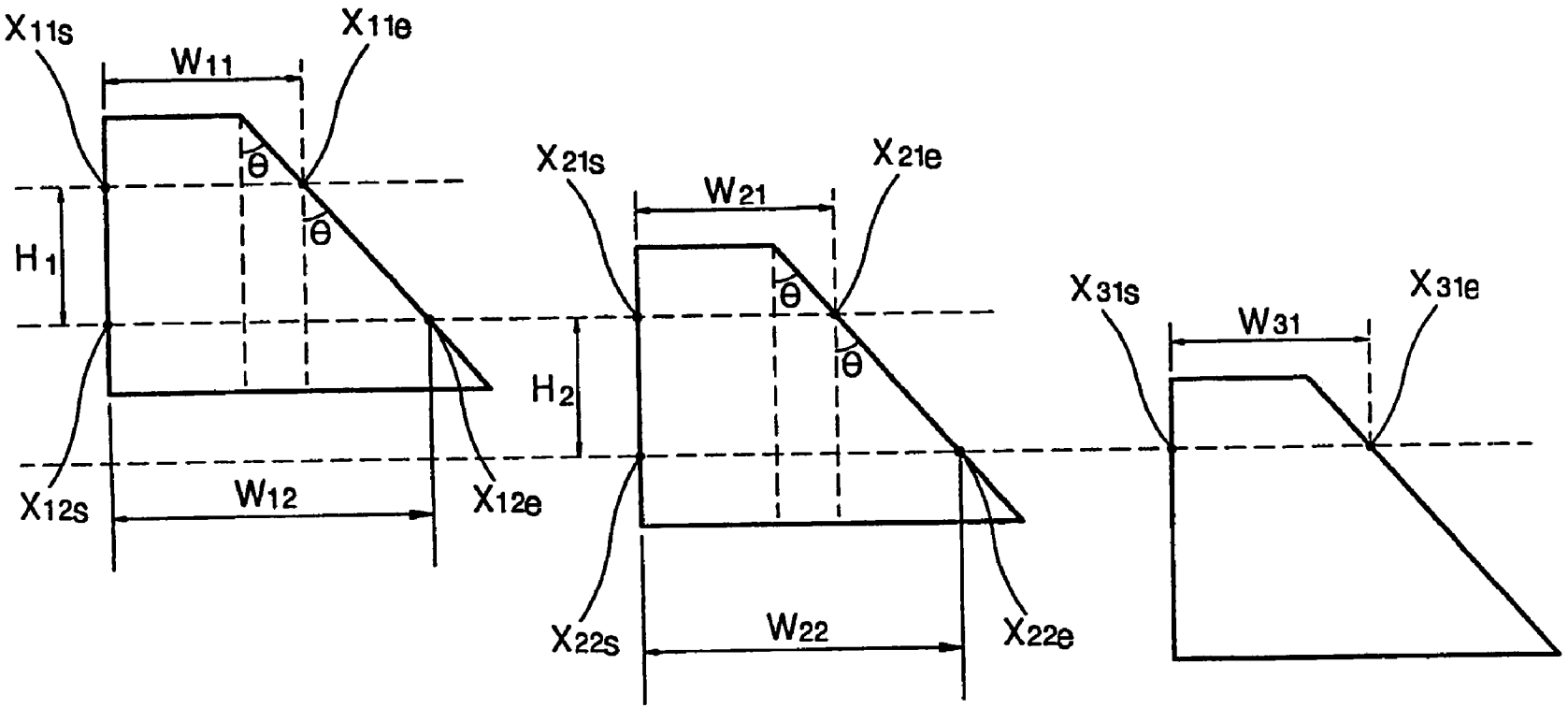
FIG. 5 illustrates a method of compensating a sheet feeding error in an ink-jet printer according to an embodiment of the present invention.
Figure 6:
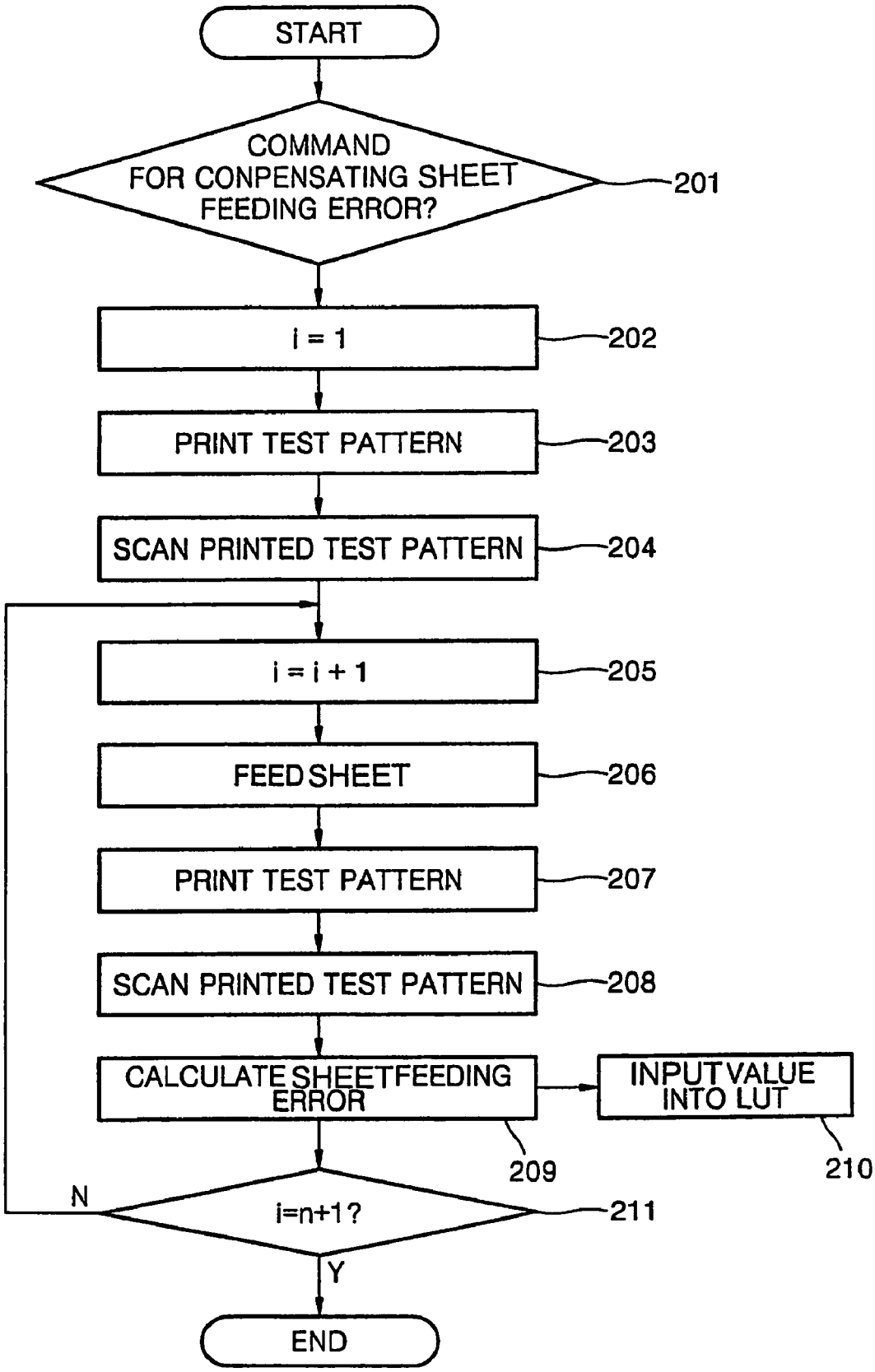
FIG. 6 is a flowchart illustrating a method of compensating a sheet feeding error in an ink-jet printer, according to an embodiment of the present invention.

FIG. 5 illustrates a method of compensating a sheet feeding error in an ink-jet printer, according to an embodiment of the present invention, and FIG. 6 is a flowchart illustrating the method of compensating a sheet feeding error in an ink-jet printer, according to an embodiment of the present invention.

In operation 201, it is checked whether a command for compensating a sheet feeding error is input to a control unit 140.

If the command for compensating the sheet feeding error is input in operation 201, in operation 202, a counting variable i is set to 1. In operation 203, a first predetermined test pattern is printed on the sheet. Generally, the test pattern is printed on the sheet by one swath. In this case, typically, the test pattern is formed in a trapezoid shape formed by a combination of a rectangle and a triangle.

Subsequently, in operation 204, the printed test pattern is scanned using the optical sensor 160 attached to the carriage 110 while the carriage 110 travels in Y direction. In this case, a traveling location of the carriage 110 is detected by counting the marks 114 of the encoder strip 116 using the linear encoder sensor 112. In other words, pulse signals generated in the linear encoder sensor 112 when the linear encoder sensor 112 passes over the marks 114 of the encoder strip 116, are transmitted to the control unit 140.

The control unit 140 comparing a starting point $X_{11s}$ and an ending point $X_{11e}$ of the first test pattern input into by the optical sensor 160 with the number of pulse signals detected by the linear encoder sensor 112, measures locations of the starting point $X_{11s}$ and the ending point $X_{11e}$ of the first test pattern, calculates a first width $W_{11}$ of the first test pattern from a difference between the starting point $X_{11s}$ and the ending point $X_{11e}$, and stores the first width $W_{11}$ in a memory.

In operation 205, the counting variable i is increased by 1.

In operation 206, the rotary encoder sensor 153 detects the number of rotating slits of the encoder disc wheel 152, and the feeding roller motor 151 is driven such that the sheet of material is fed by a predetermined distance $H_m$. Generally, the distance $H_m$ is a moving distance of the feeding roller 150 corresponding to a number of slits obtained by equally dividing the slits of the encoder disc wheel 152 by n sections. In this case, pulse signals generated in the rotary encoder sensor 153 when the slits of the encoder disc wheel 152 are passed over by the rotary encoder sensor 153, are transmitted to the control unit 140. The control unit 140 measures the driving distance $H_m$ of the feeding roller 150 by counting the number of transmitted pulse signals.

In operation 207, a second test pattern is printed to be spaced a predetermined distance $H_m$ apart from the first test pattern in a sheet feeding direction.

In operation 208, the first and second printed test patterns are scanned using the optical sensor 160 attached to the carriage 110 while the carriage 110 travels in the Y direction. In this case, the traveling location of the carriage 110 is detected by counting the marks 114 of the encoder strip 116 using the linear encoder sensor 112. In other words, pulse signals generated in the linear encoder sensor 112 when the linear encoder sensor 112 passes over the marks 114 of the encoder strip 116 are transmitted to the control unit 140.

The control unit 140 measures locations of starting points $X_{12s}$ and $X_{21s}$ and ending points $X_{12e}$ and $X_{21e}$ of each test pattern by comparing the starting point $X_{12s}$ and an ending point $X_{12e}$ of the first test pattern, a starting point $X_{21s}$ and an ending point $X_{21e}$ of the second test pattern from the optical sensor 160 with the number of pulse signals detected by the linear encoder sensor 112. The control unit 140 obtains a second width $W_{12}$ of the first test pattern and a first width $W_{21}$ of the second test pattern by the same method as described above. Next, the control unit 140 obtains a distance $H_1$ by which the sheet is actually fed in operation 204, by subtracting the first width $W_{11}$ of the first test pattern stored in operation 203 from the second width $W_{12}$, as shown in Equation 6. Next, the control unit 140 stores the first width $W_{21}$ of the second test pattern in the memory.

$$H_1=(W_{12}-W_{11})/\tan\theta \quad (6)$$

Here, θ is a preset constant.

In operation 209, a sheet feeding error is obtained by subtracting the feeding distance $H_m$ from the distance $H_1$, as shown in Equation 7.

$$E_1=H_1-H_m \quad (7)$$

In operation 210, a value obtained by adding an error $E_1$ to a set value in a first section of the encoder disc wheel 152, for example, $H_m$, is input into a look-up table (LUT) as a new set value in the first section.

In operation 211, it is determined whether the counting variable i is equal to n+1.

If it is determined in operation 211 that the counting variable i is not n+1, the method returns to operation 205. A starting point $X_{22s}$ and an ending point $X_{22e}$ of the second test pattern and a starting point $X_{31s}$ and an ending point $X_{31e}$ of the third test pattern, which are shown in FIG. 5, are detected, and a second width $W_{22}$ of the second test pattern and a first width $W_{31}$ of the third test pattern are obtained by the above-described method. An actual feeding distance $H_2$ in a second section and a feeding error $E_2$ in the second section are obtained by subtracting the first width $W_{21}$ from the second width $W_{22}$ of the second test pattern, using Equations 6 and 7.

Values in a look-up table (LUT) shown in Table 1 are obtained by repeating the above-described procedures.

TABLE 1

| Section | 1 | 2 | . . . | n |
|---|---|---|---|---|
| Predetermined distance | $H_m$ | $H_m$ | . . . | $H_m$ |
| Measured distance | $H_1$ | $H_2$ | . . . | $H_n$ |
| Error | $E_1$ | $E_2$ | . . . | $E_n$ |
| Calculated set value | $H_m + E_1$ | $H_m + E_2$ | . . . | $H_m + E_n$ |

Meanwhile, if it is determined in operation 211 that the counting variable i is equal to n+1, the method of compensating a sheet feeding error in the ink-jet printer is terminated.

When the above-described method is terminated, signals to control the feeding roller are output based on a compensated value corresponding to the section of the feeding roller.

As described above, in the method of compensating a sheet feeding error in an ink-jet printer according to the present invention, the sheet feeding error is easily measured and compensated using an optical sensor. In particular, the sheet feeding error in each section of a feeding roller is compensated by measuring a feeding error of each section of the feeding roller, such that a precise printing operation is performed.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of compensating a sheet feeding error in an ink-jet printer, the printer comprising a rotation measuring unit of a sheet feeding roller, a unit to measure a reciprocating movement of an ink cartridge mounted on a carriage, and a sensor to measure an image printed on a sheet of material, the method comprising:

printing a test pattern on the sheet;

scanning the printed test pattern using the image sensor and measuring a distance $W_1$ between a starting point $X_{1s}$ and an ending point $X_{1e}$ of the test pattern;

driving the feeding roller and moving the sheet to a set distance $H_m$ so that the set distance $H_m$ is shorter than a length of the test pattern in a sheet feeding direction;

scanning the test pattern using the image sensor and measuring a distance $W_2$ between a starting point $X_{2s}$ and an ending point $X_{2e}$ of the test pattern;

calculating a feeding distance H, along which the sheet is actually fed, from a difference between the distances $W_2$ and $W_1$;

calculating a sheet feeding error E of the sheet from a difference between the feeding distance H and the set distance $H_m$; and compensating for the sheet feeding error E at the set distance $H_m$.

2. The method of claim 1, wherein in the operation of printing a test pattern, the test pattern is printed within one swath.

3. The method of claim 1, wherein the image sensor is an optical sensor attached to the carriage.

4. The method of claim 3, wherein in the operation of scanning the printed test pattern, locations of a starting point and an end point where a line scanned by the optical sensor intersects the test pattern are detected by counting marks of an encoder strip using a linear encoder sensor mounted on the carriage.

5. The method of claim 1, wherein the rotation measuring unit is a rotary encoder sensor to sense slits of an encoder disc wheel installed on a circumference of the feeding roller, and in the operation of driving the feeding roller and moving the sheet, the feeding roller is controlled by the rotary encodes sensor to be rotated by a predetermined angle.

6. The method of claim 1, wherein the test pattern is a right triangle, the right angle of which is formed on an end of a side parallel to the sheet feeding direction, and in the operation of driving the feeding roller and moving the sheet, the feeding distance H is calculated from an angle θ to face a side of the right triangle perpendicular to the sheet feeding direction, by Equation 1:

$$H=(W_2-W_1)/\tan\theta \quad (1).$$

7. The method of claim 1, wherein the test pattern is formed by a combination of a rectangle and a right triangle having a same height as a height of the rectangle, and one side of the triangle having a same height as a vertical side of the rectangle perpendicular to the sheet feeding direction is connected to the vertical side of the rectangle, and in the operation of calculating the feeding distance H, the feeding distance H is calculated from an angle θ to face a side of the right triangle perpendicular to the sheet feeding direction, by Equation 1:

$$H=(W_2-W_1)/\tan\theta \quad (1).$$

8. The method of claim 1, wherein in the operation of driving the feeding roller and moving the sheet, the feeding roller is driven by a set distance $H_m$ which corresponds to a first section where a circumference of the feeding roller is equally divided by n sections so that the set distance $H_m$ is shorter than the length of the test pattern in the sheet feeding direction, and further comprising an operation of repeatedly performing the operations of claim 1 for each other section of the circumference of the feeding roller.

9. The method of claim 8, wherein the operation of compensation for the sheet feeding error E comprises:

storing the sheet feeding error E in a look-up table; and setting a distance obtained by compensating for the sheet feeding error E at the set distance $H_m$ as a compensated set distance of a corresponding section.

10. The method of claim 8, wherein in the operation of driving the feeding roller and moving the sheet, a second test pattern used to detect a sheet feeding error in a next section is printed, and in the operation of scanning the test pattern using the image sensor, the distance $W_1$ between the starting point $X_{1s}$ and the end point $X_{1e}$ of the second test pattern is calculated.

* * * * *

UNITED STATES PATENT AND TRADEMARK OFFICE

CERTIFICATE OF CORRECTION

PATENT NO. : 7,083,251 B2
APPLICATION NO. : 10/753333
DATED : August 1, 2006
INVENTOR(S) : Kyung-pyo Kang et al.

It is certified that error appears in the above-identified patent and that said Letters Patent is hereby corrected as shown below:

Column 8, Line 35, change “encodes” to --encoder--.

Signed and Sealed this

Twenty-sixth Day of December, 2006

JON W. DUDAS
*Director of the United States Patent and Trademark Office*